United States Patent [19]

Steck et al.

[11] 4,295,879

[45] Oct. 20, 1981

[54] MANUFACTURE OF ACICULAR FERROMAGNETIC IRON PARTICLES

[75] Inventors: Werner Steck, Mutterstadt; Wilhelm Sarnecki, Limburgerhof; Laszlo Marosi, Ludwigshafen; Manfred Ohlinger, Frankenthal; Horst Autzen, Freinsheim, all of Fed. Rep. of Germany

[73] Assignee: BASF Aktiengesellschaft, Fed. Rep. of Germany

[21] Appl. No.: 174,240

[22] Filed: Jul. 31, 1980

[30] Foreign Application Priority Data

Sep. 1, 1979 [DE] Fed. Rep. of Germany ..... 2935357

[51] Int. Cl.[3] ..... B22F 9/00

[52] U.S. Cl. ..... 75/0.5 AA; 148/105; 252/62.55

[58] Field of Search ..... 75/0.5 AA, 0.5 BA; 148/105; 252/62.55, 62.56; 427/127; 428/900

[56] References Cited

U.S. PATENT DOCUMENTS

| | | | |
|---|---|---|---|
| 3,082,067 | 3/1963 | Hund | 423/634 |
| 3,607,220 | 9/1971 | van der Giessen et al. | 75/0.5 AA |
| 3,627,509 | 12/1971 | van der Giessen et al. | 75/0.5 AA |
| 3,702,270 | 11/1972 | Kawasaki et al. | 75/0.5 AA |
| 4,017,303 | 4/1977 | Koester | 75/0.5 AA |
| 4,050,962 | 9/1977 | Koester | 148/105 |
| 4,155,748 | 5/1979 | Steck et al. | 75/0.5 AA |
| 4,178,171 | 12/1979 | Steck et al. | 75/0.5 AA |

*Primary Examiner*—L. Dewayne Rutledge
*Assistant Examiner*—John P. Sheehan
*Attorney, Agent, or Firm*—Keil & Witherspoon

[57] ABSTRACT

A process for the manufacture of acicular ferromagnetic iron particles by reducing an iron(III) oxide which carries a shape-stabilizing surface coating and has been produced by heating acicular iron(III) oxide hydroxide at 250°-390° C. in an atmosphere containing water vapor at a partial pressure of not less than 30 mbar, with hydrogen at 275°-425° C.

2 Claims, No Drawings

MANUFACTURE OF ACICULAR FERROMAGNETIC IRON PARTICLES

The present invention relates to a process for the manufacture of acicular ferromagnetic iron particles by reducing iron(III) oxide which possesses a shape-stabilizing surface coating and has been obtained by heating acicular iron(III) oxide hydroxide, with hydrogen at 275°–425° C.

Because of their high saturation magnetization and the high coercive force achievable, ferromagnetic metal powders and thin metal layers are of particular interest for the manufacture of magnetic recording media. This is due to the fact that they permit a substantial increase in the energy product and the information density, so that narrower signal widths and higher signal amplitudes can be achieved with such recording media.

It is true that, when acicular ferromagnetic metal powders are used as magnetizable materials in the manufacture of magnetic recording media, the mechanical properties of such media can, in contrast to the use of homogeneous thin metal layers, be varied within wide limits by appropriate choice of the polymeric organic binder system, but in that case high demands are made not only on the magnetic properties but also on their shape, size and dispersibility.

Since a high coercive force and a high residual induction are essential prerequisites for magnetic pigments intended for magnetic coatings serving as data storage memories, the metal particles employed must exhibit single-domain behavior and furthermore the existing anisotropy of the particles or the anisotropy additionally achievable in the tape by orientation of the magnetic particles should only be slightly affected by external factors, for example elevated temperatures or mechanical stresses, i.e. the small particles should exhibit shape anisotropy and preferably be acicular, and should in general have a size of from $10^2$ to $10^4$ Å.

It is known that iron particles of the type described can be produced by reducing finely divided acicular iron compounds, e.g. the oxides, with hydrogen or with some other gaseous reducing agent. The reduction must be carried out at above 300° C. if it is to take place at an industrially acceptable speed. However, this is attended by the problem of sintering of the resulting metal particles. As a result, the particle shape no longer conforms to that required to give the desired magnetic properties.

In order to lower the reduction temperature, it has already been proposed, in German Laid-Open Application DOS No. 2,014,500, to catalyze the reduction by applying silver or a silver compound to the surface of finely divided iron oxide. The treatment of the iron oxide with tin(II) chloride has also been described (German Laid-Open Application DOS No. 1,907,691).

However, the catalytic acceleration of the reduction of preferably acicular starting compounds in general gives needles which are far smaller than those of the starting material, and furthermore the length-to-width ratio is low. As a result, the end product exhibits a rather broad particle size spectrum. On the other hand, it is known that the dependence of the coercive force and residual induction of magnetic materials on their particle size is very great when the particles are of a size of the order of magnitude of single-domain particles. If to this are added the effects resulting from the presence of a proportion of superparamagnetic particles, which may be formed as fragments in the above process, such magnetic materials are unsuitable for use in the manufacture of magnetic recording media. With such heterogeneous mixtures the magnetic field strength required to reverse the magnetization of the particles varies greatly, and the distribution of the residual magnetization as a function of the applied external field also gives a less steep residual induction curve.

Attempts to provide the iron oxides, which are to be reduced, with a surface coating in order to prevent sintering of the individual particles at the required reduction temperature, such attempts being described, for example, in German Laid-Open Applications DOS Nos. 2,434,058, 2,434,096, 2,646,348 and 2,714,588, have also not proved entirely satisfactory.

It is an object of the present invention to provide a process for the manufacture of acicular ferromagnetic iron particles, by means of which particles exhibiting a pronounced shape anisotropy and a high coercive force, remanence and relative remanence can be produced in a simple manner.

We have found that acicular ferromagnetic iron particles having the required properties can be produced from acicular iron(III) oxide, possessing a shape-stabilizing surface coating, by reduction with hydrogen at 275°–425° C. if the acicular iron(III) oxide employed is obtained from acicular iron(III) oxide hydroxide by heating for from 10 minutes to 10 hours at from 250° to 390° C. in an atmosphere containing water vapor at a partial pressure ($pH_2O$) of not less than 30 mbar.

It is particularly advantageous to employ, as the starting material for the novel process, iron(III) oxide hydroxide in the form of lepidocrocite ($\gamma$-FeOOH) or of a mixture of goethite ($\alpha$-FeOOH) and lepidocrocite, containing not less than 20 percent by weight of lepidocrocite, and to heat this material for from 10 minutes to 10 hours at from 250° to 390° C. in an atmosphere containing water vapor at a partial pressure (S.T.P.) of from 30 to 1013 mbar.

The above iron(III) oxide hydroxides have a specific surface area, measured by the BET method, of from 20 to 75 $m^2/g$, a mean particle length of from 0.2 to 1.5 $\mu m$, preferably from 0.3 to 1.2 $\mu m$, and a length/width ratio of not less than 10:1, advantageously of from 10 to 40:1. They can be prepared from an iron(II) salt solution by treatment with an alkali, accompanied by oxidation, for example as described in German Published Application DAS No. 1,061,760. For this purpose iron(III) oxide hydroxide nuclei are precipitated from an aqueous iron(II) chloride solution by means of an alkali, such as an alkali metal hydroxide or ammonia, at from 10° to 36° C., with vigorous stirring to produce fine air bubbles, up to an amount of 25 to 60 mole % of the iron employed, the iron(III) oxide hydroxide being subsequently produced from the nuclei, by growth of the latter, at from 20° to 70° C. and a pH of from 4.0 to 5.8 obtained by adding further amounts of alkali, whilst vigorously dispersing the air present. After nuclei growth has stopped, the content of iron(III) oxide hydroxide in the aqueous suspension should be from 10 to 70 g/l, preferably from 15 to 65 g/l. The precipitate is filtered off and washed, and the iron(III) oxide hydroxide thus obtained is dried at from 60° to 200° C.

This iron(III) oxide hydroxide required for the novel process is then provided, in a conventional manner, with a surface coating which assists in preserving the external shape of the particles during the further processing steps. A suitable method is, for example, to treat the iron(III) oxide hydroxide with an alkaline earth metal cation and a carboxylic acid or some other organic compound which possesses two or more groups capable of chelating the alkaline earth metal cation. Such processes are described in German Laid-Open Applications DOS Nos. 2,434,058 and 2,434,096.

Another conventional method, described in German Laid-Open Application DOS No. 2,646,348 which corresponds to U.S. Pat. No. 4,155,748), is to stabilize the shape of the iron(III) oxide hydroxide particles by surface treatment with a hydrolysis-resistant phosphorus oxyacid, or a salt or ester thereof and a carboxylic acid. Examples of suitable hydrolysis-resistant substances are phosphoric acid, soluble monophosphates, diphosphates or triphosphates, eg. potassium or ammonium dihydrogen phosphate, disodium or dilithium orthophosphate and trisodium phosphate, sodium pyrophosphate and metaphosphates, eg. sodium metaphosphate. The compounds may be employed individually or as mixtures with one another. The use of a phosphoric acid ester of an aliphatic monoalcohol of 1 to 6 carbon atoms, eg. of tert.-butyl esters of phosphoric acid, is advantageous. Suitable carboxylic acids include saturated or unsaturated aliphatic carboxylic acids of up to 6 carbon atoms, which possess up to 3 acid groups and in which one or more hydrogen atoms of the aliphatic chain may be substituted by hydroxyl or amino. Hydroxydicarboxylic acids and hydroxy-tricarboxylic acids, e.g. tartaric acid and citric acid, as well as oxalic acid are particularly suitable.

According to the process of the invention, the iron(III) oxide hydroxide which has been subjected to a shape-stabilizing treatment as described, is then heated for from 10 minutes to 10 hours at from 250° to 390° C. in an atmosphere containing water vapor at a partial pressure of not less than 30 mbar. The end product is an acicular iron(III) oxide having a surface coating formed in accordance with the preceding surface treatment.

This heating step may be carried out batchwise or continuously. For batchwise dehydration, reactors such as muffle furnaces, rotary kilns or fluidized-bed furnaces may be used. To achieve better mixing, air, an inert gas or a mixture of air and an inert gas may be passed over or through the static or agitated iron oxide, the gas first being laden with the appropriate amount of water vapor. Advantageously, the gas or gas mixture is saturated with water vapor at from 40° C. to the boiling point of water, especially from 50° C. to the boiling point of water, and is passed into the reactor in this saturated form. The water can of course also be introduced direct in the form of steam, or be admixed in the form of steam to the other gases. Heating may be carried out particularly advantageously in continuous reactors, for example a continuous rotary kiln, since here, in addition to the water vapor in the gas passed through the furnace, water vapor is also supplied continuously, in constant amount, from the iron(III) oxide hydroxide dehydration reaction. Hence, this continuous treatment can also be carried out without a stream of inert gas or of air, or with only a slight stream of inert gas or of air. After a brief period for reaching steady-state conditions, the required water vapor partial pressure, preferably of 70 to 1013 mbar, is reached in the reaction chamber.

In another advantageous embodiment of the process according to the invention, the iron(III) oxide hydroxide of the stated composition is directly subjected to heating and is then given a surface treatment as described.

To produce the acicular ferromagnetic iron particles, the iron(III) oxide carrying a shape-stabilizing surface coating is reduced in a conventional manner with hydrogen at from 275° to 425° C., preferably from 300° to 400° C. It is advantageous to passivate the resulting finely divided iron powder by passing a mixture of air and inert gas, or oxygen and inert gas, over the material, since the pyrophoric character of the acicular iron particles, having a length of from 0.1 to 0.8 μm and a length-to-width ratio of from 5:1 to 25:1, can thereby be kept under control.

Using the novel process, it is possible to produce acicular ferromagnetic iron particles which exhibit excellent shape anisotropy. This is achieved because the starting materials are substantially dendrite-free and have been treated to retain their external shape, and since the heating according to the invention gives an iron(III) oxide, having a uniform crystal structure, for the subsequent reduction reaction. Consequently, the resulting iron particles are distinguished by a substantially improved coercive force, specific remanence and relative remanence. If the iron particles obtained according to the invention are used in a conventional manner for the production of magnetic recording media, the acicular particles can be magnetically oriented especially easily, and furthermore the important electroacoustic properties, such as maximum output level at short and long wavelengths, are improved.

The Examples which follow illustrate the process according to the invention and, together with the Comparative Experiments, demonstrate the advance in the art that has been achieved.

The acicular iron(III) oxide hydroxides employed, such as lepidocrocite and goethite/lepidocrocite mixtures, were primarily characterized by the surface area $S_{N2}$ determined by the BET method, using nitrogen. Electron micrographs provided information on the appearance and dimensions (length-to-width ratio) of the iron oxide hydroxide particles. The goethite/lepidocrocite ratio was determined by X-ray methods.

The magnetic properties of the iron powders were measured by means of a vibrating sample magnetometer at a field strength of 160 or 800 kA/m. The coercive force, $H_c$, measured in kA/m, was based on a tap density $\rho$ of 1.6 g/cm$^3$. The specific remanence ($M_{r/\rho}$) and specific saturation magnetization ($M_{m/\rho}$) are each given in nTm$^3$/g.

In addition to a high coercive force $H_c$ and a high residual induction, the remanence coercivity $H_R$ is an important parameter for assessing the product. In d.c. demagnetization, half (by volume) of the particles are reverse-magnetized at a field strength which is equivalent to the remanence coercivity $H_R$. Accordingly, $H_R$ is a characteristic parameter for recording processes which, in particular, determines the bias setting for magnetic recording. The more non-uniform the remanence coercivity of the individual magnetic particles in the recording layer, the broader is the distribution of the magnetic fields which are able to receive the magnetization of a defined volume of the recording layer. This is particularly noticeable if, because of high recording densities or short wavelengths, the boundary zone between zones of opposite magnetization is narrow. To characterize the distribution of the field strengths of the individual particles, a value $h_5$ for the total width of the remanence curve and a value $h_{25}$ for the slope of the remanence curve are determined from the d.c. demagnetization curve. The values are determined using the equations $$h_5 = \frac{H_{95} - H_5}{H_R} \text{ and}$$

$$h_{25} = \frac{H_{75} - H_{25}}{H_R}$$

The subscript following the letter H indicates what percentage of the particles has in each case been reverse-magnetized.

COMPARATIVE EXPERIMENT 1

An iron(III) oxide hydroxide (sample A) having a specific surface area $S_{N2}$ of 37.6 $m^2/g$, and consisting of a mixture of 95% of γ-FeOOH and 5% of α-FeOOH, is produced in accordance with German Published Application DAS No. 1,061,760.

70 parts of sample A are heated in a rotary kiln at 350° C. under a pressure of 25 mbar for one hour. To keep the pressure constant, air, which has been dried over silica gel, is bled in, as required, through a vacuum valve. The resulting iron(III) oxide (sample B) has a surface area of 51.3 $m^2g$.

A further 70 parts of Sample A are heated in the same rotary kiln at 350° C. for one hour. In this case, however, 100 liters (S.T.P.)/h of a mixture of air and water vapor $p_{H22}$ 845 mbar) are passed over the pigment. The resulting iron(III) oxide (sample c) has a surface area of 34.9 $m^2/g$.

50° C., giving sample 5b. The results of the measurements are shown in Table 1.

COMPARATIVE EXPERIMENT 2

50 parts of sample A from Comparative Experiment 1 are stirred into 400 parts by volume of water. After dispersing the sample for 10 minutes, a solution of 4.5 parts by volume of water, 0.35 part by volume of 85% strength $H_3PO_4$ and 0.5 part of $H_2C_2O_4.2H_2O$ is added. After all had been dispersed, the water is filtered off and the filter cake is dried in air at 170° C., to give sample F. This has a surface area of 37 $m^2/g$, a phosphate content of 1.4% by weight and a carbon content of 0.14% by weight.

70 parts of sample F are heated, as described in Comparative Experiment 1, under 25 mbar pressure, to give iron(III) oxide sample G, having a surface area of 53.9 $m^2/g$, and this material is then reduced as described in the same Comparative Experiment, to give iron pigment No. 6. The results of the measurements are shown in Table 1.

EXAMPLE 2

A further 70 parts of sample F are heated in a stream of air containing water vapor, as described in Comparative Experiment 1, to give iron(III) oxide sample H, having a surface area of 47.9 $m^2g$. The reduction of sample H to the iron pigment 7 is also carried out as described in Comparative Experiment 1. The results of the measurements are shown in Table 1.

TABLE 1

| | Iron Oxide hydroxide or iron oxide | | Sample | Magnetic properties of the Iron pigments at 160 kA/m | | | |
|---|---|---|---|---|---|---|---|
| | Sample | $S_{N2}[m^2/g]$ | No. | $H_c(\rho = 1.6)$ | $M_m/\rho$ | $M_R/\rho$ | $M_r/M_m$ |
| Comparative Experiment 1 | A | 37.6 | 1 | 40.8 | 171 | 85 | 0.05 |
| Comparative Experiment 1 | B | 51.3 | 2 | 42.3 | 164 | 78 | 0.48 |
| Comparative Experiment 1 | C | 34.9 | 3 | 42.1 | 160 | 76 | 0.48 |
| Example 1 | D | 42.1 | 4 | 34.2 | 162 | 64 | 0.40 |
| Example 1 | E | 36.3 | $5^d$ | 62.0 | 153 | 79 | 0.52 |
| Example 1 | | | $5^b$ | 66.9 | 120 | 63 | 0.53 |
| Comparative Experiment 2 | F | 37.0 | | | | | |
| Comparative Experiment 2 | G | 53.9 | 6 | 52.4 | 156 | 75 | 0.48 |
| Example 2 | H | 47.9 | 7 | 60.4 | 142 | 70 | 0.49 |

5 parts each of samples A, B and C are reduced to the iron pigments 1 to 3 in a rotary kiln at 350° C. for 8 hours in a stream of hydrogen of 30 liters (S.T.P.)/h. The results of the measurements are shown in Table 1.

EXAMPLE 1

In each case 45 parts of sample B and sample C from Comparative Experiment 1 are suspended, with vigorous stirring, in 450 parts by volume of $H_2O$. 0.35 part by volume of 85% strength phosphoric acid ($H_3PO_4$) and 0.5 part of $H_2C_2O_4.2H_2O$ (oxalic acid) are then dissolved in 20 parts by volume of water and added to the dispersion. After stirring for 20 minutes, the solid is filtered off and the filter cake is dried in air at 170° C. Sample D produced from sample B has a surface area of 42.1 $m^2/g$, a phosphate content of 1.1% by weight and a carbon content of 0.06% by weight. The corresponding values of sample E, produced from sample C, are: surface area 36.3 $m^2/g$, phosphate content 1.2% by weight and carbon content 0.04% by weight. Samples D and E are reduced to the iron pigments 4 and 5a as described in Comparative Experiment 1. A part of sample 5a is passivated in an air/nitrogen mixture at below

COMPARATIVE EXPERIMENT 3

An iron(III) oxide hydroxide, produced as described in German Published Application DAS No. 1,061,760, consists of 97% of γ-FeOOH and 3% of α-FeOOH and has a surface area of 32.7 $m^2g$ (sample J).

70 parts of sample J are heated under reduced pressure for one hour, as described in Comparative Experiment 1, to give pigment K1, having a surface area of 44.8 $m^2/g$, and a further 70 parts are heated in the same manner for 3 hours to give sample K2 having a surface area of 40.8 $m^2/g$. In addition, portions each of 70 parts of sample J are heated for 1 and 3 hours respectively in an atmosphere containing water vapor, again as described in Comparative Experiment 1, to give samples L1 and L2. L1 has a surface area of 33.0 $m^2/g$ and L2 a surface area of 30.4 $m^2/g$.

Samples K1, K2, L1 and L2 are then reduced at 350° C., as described in Comparative Experiment 1, to give the iron pigments 8 to 11. The results of the measurements are shown in Table 2.

COMPARATIVE EXPERIMENT 4 AND EXAMPLE 3

45 parts of each of the heat-treated products K1, K2, L1 and L2 are provided with a surface coating as described in Example 1, giving samples K3, K4, L3 and L4 respectively.

| | Starting material | Sample | Coated product $PO_4^{2-}$ [% by weight] | C [% by weight] | $S_{N2}$ [$m^2/g$] |
|---|---|---|---|---|---|
| Comparative Experiment 4 | K1 | K3 | 1.0 | 0.11 | 46.6 |
| Comparative Experiment 4 | K2 | K4 | 1.0 | 0.03 | 40.3 |
| Example 3 | L1 | L3 | 1.0 | 0.03 | 33.6 |
| " | L2 | L4 | 0.82 | 0.03 | 28.7 |

These materials are then reduced at 350° C., as described in Comparative Experiment 1, to give the iron pigments 12a to 15a, and parts of samples 12a to 15a are passivated, as described in Example 1, to give the iron pigments 12b to 15b. The results of the measurements are shown in Tables 2 and 3.

TABLE 2

| | Iron oxide hydroxide or iron oxide | | Sample | Magnetic properties of the iron pigments at 160 kA/m | | | |
|---|---|---|---|---|---|---|---|
| | Sample | $S_{N2}$[$m^2/g$] | No. | $H_c(\rho = 1.6)$ | $M_m/\rho$ | $M_r/\rho$ | $M_r/M_m$ |
| Comparative Experiment 3 | J | 32.7 | | — | — | — | — |
| " | K1 | 44.8 | 8 | 25.2 | 153 | 54 | 0.35 |
| " | K2 | 40.8 | 9 | 26.0 | 159 | 54 | 0.34 |
| " | L1 | 33.0 | 10 | 22.7 | 150 | 48 | 0.32 |
| " | L2 | 30.4 | 11 | 24.9 | 158 | 53 | 0.34 |
| Comparative Experiment 4 | K3 | 46.6 | 12a | 60.3 | 144 | 74 | 0.51 |
| | | | 12b | 61.6 | 173 | 62 | 0.05 |
| " | K4 | 40.3 | 13a | 59.8 | 149 | 81 | 0.55 |
| | | | 13b | 61.3 | 125 | 66 | 0.53 |
| Example 3 | L3 | 33.6 | 14a | 61.9 | 154 | 89 | 0.58 |
| | | | 14b | 65.3 | 124 | 73 | 0.59 |
| " | L4 | 25.7 | 15a | 61.3 | 163 | 100 | 0.61 |
| | | | 15b | 64.7 | 126 | 78 | 0.62 |

TABLE 3

| | Iron pigment Sample No. | $M_s/\rho$ | $M_r/M_s$ | $H_rH_R(\rho = 1.6)$ (measured at 800 kA/m) | $H_R/H_c$ | $h_{25}$ | $S_{N2}$ $m^2/g$ |
|---|---|---|---|---|---|---|---|
| Comparative Experiment 4 | 12a | 238 | 0.42 | 95.2 | 1.35 | 0.69 | — |
| " | 12b | 212 | 0.42 | 99.7 | 1.35 | 0.65 | 19.7 |
| Example 3 | 14a | 249 | 0.45 | 89.5 | 1.28 | 0.63 | — |
| " | 14b | 196 | 0.47 | 92.9 | 1.27 | 0.62 | 19.4 |
| Comparative Experiment 4 | 13a | 249 | 0.43 | 88.1 | 1.30 | 0.69 | — |
| " | 13b | 207 | 0.43 | 94.7 | 1.34 | 0.71 | 17.8 |
| Example 3 | 15a | 246 | 0.47 | 80.7 | 1.24 | 0.65 | — |
| " | 15b | 200 | 0.48 | 87.0 | 1.25 | 0.63 | 17.3 |

COMPARATIVE EXPERIMENT 5

The starting material employed is a conventionally produced γ-FeOOH, which is pure according to X-ray examination, and has a surface area of 33.4 $m^2g$ (sample M).

50 parts of this sample M are treated, as described in Example 1, with 1% of $H_3PO_4$ and 1% of $H_2C_2O_4.2H_2O$ (the percentages being by weight, based on γ-FeOOH), filtered off and dried. The resulting product M1 has a phosphate content of 1.4% by weight, a carbon content of 0.06% by weight and a surface area of 36.8 $m^2g$.

The reduction is carried out as described in Comparative Experiment 1. The results of the measurements on the resulting iron pigment No. 16 are shown in Table 4.

EXAMPLE 4

50 parts of sample M are heated in a continuous rotary kiln in a stream of nitrogen, containing water vapor, at 350° C., the mean residence time being 45 minutes. To obtain a water vapor partial pressure $pH_2O$ of 88 mbar, only a slight stream of inert gas, namely 400 liters (S.T.P.) of nitrogen/h, is passed cocurrently through the reactor. The resulting iron(III) oxide is treated as described in Example 1; the product has a phosphate content of 1.2% by weight, a carbon content of 0.06% by weight and a surface area of 23.4 $m^2/g$; it constitutes sample M2. This sample is reduced in the same manner as sample M1 from Comparative Experiment 5, thereby giving iron pigment No. 17, the magnetic properties of which are shown in Table 4.

TABLE 4

| | Iron Oxide hydroxide or oxide | Sample Iron pigments No. | $H_c(\rho = 1.6)$ | $M_m/\rho$ | $M_r/\rho$ | $M_r/M_m$ |
|---|---|---|---|---|---|---|
| Comparative Experiment 5 | M1 | 16 | 50.5 | 147 | 80 | 0.55 |
| Example 4 | M2 | 17 | 58.6 | 157 | 91 | 0.58 |

EXAMPLE 5

The starting materials used are the conventionally produced iron(III) oxide hydroxides sample N (γ-FeOOH containing 30% of α-FeOOH and having a surface area of 26.1 $m^2/g$ and sample O (γ-FeOOH containing 68% of α-FeOOH and having a surface area of 39.0 $m^2/g$.

In each case 50 parts of sample N and sample O are suspended in 500 parts by volume of water and 0.70 part by volume of 85% strength phosphoric acid ($H_3PO_4$) and one part of $H_2C_2O_4.2\ H_2O$ (oxalic acid), dissolved in 30 parts by volume of water, are then added. The mixture is stirred for 10 minutes, the solid is filtered off and the filter cake is dried at 170° C. in air, giving samples N1 and O1 respectively. The process conditions for the heating of each sample, and, where relevant, the subsequent surface treatment, and the surface areas and carbon/phosphorus analyses are shown in Table 5. The magnetic properties of the iron pigments 18a, 21a and 22a obtained from samples N5, O6 and O7 respectively by reduction with hydrogen at 350° C., and of the passivated iron pigments 18b, 21b and 22b obtained by passing a mixture of nitrogen and air over pigments 18a, 21a and 22a respectively at below 50° C., are shown in Table 6.

COMPARATIVE EXPERIMENT 6

The process conditions for the production of the iron pigments 17, 19, 20 and 21, derived from samples N and O, are shown in Tables 5 and 6, as are the results of the measurements.

TABLE 5

| Sample | Notes | $S_{N2}$ $m^2/g$ | $PO_4^{3-}$ % by weight | C % by weight |
|---|---|---|---|---|
| N | γ-FeOOH containing 30% of α-FeOOH | 26.1 | — | — |
| N1 | Sample N coated with $H_3PO_4/H_2C_2O_4$ | 56.7 | 0.84 | 0.02 |
| N2 | Sample N heated under reduced pressure at 350° C. | 38.2 | — | — |
| N3 | Sample N2 coated with $H_3PO_4/H_2C_2O_4$ | — | 1.00 | 0.04 |
| N4 | Sample N heated in an atmosphere containing water vapor at 350° C. | 34.9 | — | — |
| N5 | Sample N4 coated with $H_3PO_4/H_2C_2O_4$ | — | 1.10 | 0.02 |
| 0 | γ-FeOOH containing 68% of α-FeOOH | 39.0 | — | — |
| 01 | Sample 0 coated with $H_3PO_4/H_2C_2O_4$ | 37.4 | 0.89 | 0.10 |
| 02 | Sample 0 heated under reduced pressure at 350° C. | 70.2 | — | — |
| 03 | Sample 02 coated with $H_3PO_4/H_2C_2O_4$ | — | 0.92 | 0.06 |
| 04 | Sample 0 heated in an atmosphere containing water vapor at 350° C. | 43.7 | — | — |
| 05 | Sample 0 heated in an atmosphere containing water vapor at 300° C. | 48.2 | — | — |
| 06 | Sample 04 coated with $H_3PO_4/H_2C_2O_4$ | — | 1.1 | 0.03 |
| 07 | Sample 05 coated with $H_3PO_4/H_2C_2O_4$ | | 1.3 | 0.05 |

TABLE 6

| Starting material from Table 5 | Fe pigment No. | $H_c(\rho = 1.6)$ | $M_m/\rho$ | $M_r/\rho$ | $M_r/M_m$ | Remarks |
|---|---|---|---|---|---|---|
| N1 | 17a | 54.2 | 148 | 80 | 0.54 | pyrophoric |
| N3 | 18a | 53.8 | 156 | 83 | 0.53 | pyrophoric |
| | 18b | 57.3 | 144 | 89 | 0.53 | sample N3 passivated |
| N5 | 19a | 63.8 | 148 | 87 | 0.59 | pyrophoric |
| | 19b | 64.0 | 137 | 82 | 0.62 | sample N5 passivated |
| 01 | 20 | 51.3 | 155 | 80 | 0.52 | pyrophoric |
| 03 | 20a | 54.7 | 170 | 96 | 0.56 | pyrophoric |
| | 20b | 55.8 | 122 | 68 | 0.56 | sample 03 passivated |
| 05 | 21a | 62.1 | 138 | 79 | 0.57 | pyrophoric |
| | 21b | 62.1 | 125 | 71 | 0.57 | sample 05 passivated |
| 07 | 22a | 59.5 | 160 | 91 | 0.57 | pyrophoric |
| | 22b | 62.1 | 124 | 71 | 0.57 | sample 07 passivated |

EXAMPLE 6

50 parts of a conventionally produced iron(III) oxide hydroxide containing 6% of α-FeOOH and 94% of γ-FeOOH, and having a surface area of 29.4 $m^2/g$, are heated, as described in Example 4, in a rotary kiln at 350° C. under a $pH_2O$ of 88 mbar, with a mean residence time of 30 minutes, and are then treated as described in Comparative Experiment 2. The resulting sample R has a surface area of 32.8 $m^2/g$, a phosphate content of 1.0% by weight and a carbon content of 0.03% by weight. After reduction with hydrogen for 8 hours at 335° C., the resulting iron pigment 23 has the properties shown in Table 7. The material is then passivated by passing a mixture of air and nitrogen over it, at below 50° C.

COMPARATIVE EXPERIMENT 7

Following the procedures described in Example 6, sample R (described in the same Example) is, without prior heating, provided with a surface coating and reduced to give iron pigment 24, which is then passivated.

The results of the measurements are shown in Table 7.

TABLE 7

| | Fe pigment No. | $H_c(\rho = 1.6)$ | $M_r/\rho$ | $M_r/M_m$ |
|---|---|---|---|---|
| Example 6 | 23 | 57.0 | 86 | 0.55 |
| Comparative Experiment 7 | 24 | 52.7 | 66 | 0.49 |

EXAMPLES 7 AND 8

In each case 800 parts of passivated iron particles No. 23 and No. 24, produced according to Example 6 and Comparative Experiment 7 respectively, are mixed, in a tube mill having a capacity of 6000 parts by volume and containing 9,000 parts of steel balls of diameter from 4 to 6 mm, with 456 parts of a 13 percent strength solution of a thermoplastic polyester-urethane (obtained from adipic acid, butane-1,4-diol and 4,4'-diisocyanatodiphenylmethane) in a solvent mixture of equal parts of tetrahydrofuran and dioxane, 296 parts of a 10 percent strength solution of a polyvinylformal binder (containing 82 percent of vinylformal units, 12 percent of vinyl acetate units and 6 percent of vinyl alcohol units), in the said solvent mixture, 20 parts of butyl stearate and a further 492 parts of the said solvent mixture, and the batch is dispersed for 4 days. A further 456 parts of the said polyester-urethane solution, 296 parts of the polyvinylformal solution and 271 parts of the solvent mixture, and 2 parts of a commercial silicone oil, are added, and the batch is dispersed for a further 24 hours and filtered through a cellulose/asbestos fiber layer. The magnetic dispersion thus obtained is applied to an 11.5 μm thick polyethylene terephthalate base film, using a conventional coating apparatus, and, after the coated base has passed through a magnetic orienting field, the coating is dried in the course of 2 minutes at 80° to 100° C. The coated base is then calendered by passing it between polished rollers heated to 60° to 80° C. The finished magnetic coating is 3.9 μm thick.

The magnetic properties of the layer are shown in Table 8.

TABLE 8

| | Sample No. | $H_c$ | $M_r$ [mT] | $M_r/M_m$ |
|---|---|---|---|---|
| Example 7 | 23 | 62.3 | 319 | 0.08 |

TABLE 8-continued

| | Sample No. | $H_c$ | $M_r$ [mT] | $M_r/M_m$ |
|---|---|---|---|---|
| Example 8 | 24 | 56.7 | 287 | 0.75 |

We claim:

1. A process for the manufacture of acicular ferromagnetic iron particles, comprising:

(a) coating the surface of acicular particles of iron(III) oxide hydroxide and consisting of 20 to 100 percent by weight of lepidocrocite and 0 to 80 percent by weight of geothite with an alkaline earth metal compound and a monobasic, dibasic or tribasic aliphatic carboxylic acid of up to 6 carbon atoms, or an alkaline earth metal chelate of an organic compound containing at least two groups capable of chelating an alkaline earth metal cation, or a hydrolysis-resistant substance consisting of a phosphorus oxyacid, its ester or its inorganic salt and an aliphatic mono-, di- or tribasic carboxylic acid of 1 to 6 carbon atoms, (b) heating the so-coated particles at a temperature of from 250° to 390° C. for a period of from 10 minutes to 10 hours in an atmosphere containing water vapor at a partial pressure of from 30 to 1013 mbar, and (c) reducing the iron(III) oxide particles thus obtained with hydrogen at temperatures of from 275° to 425° C. to form acicular ferromagnetic iron particles.

2. A process for the manufacture of acicular ferromagnetic iron particles, comprising:

(a) heating acicular particles of iron(III) oxide hydroxide and consisting of 20 to 100 percent by weight of lepidocrocite and 0 to 80 percent by weight of geothite at a temperature of from 250° to 390° C. for a period of from 10 minutes to 10 hours in an atmosphere containing water vapor at a partial pressure of from 30 to 1013 mbar, (b) coating the so-treated particles with an alkaline earth metal compound and a monobasic, dibasic or tribasic aliphatic carboxylic acid of up to 6 carbon atoms, or an alkaline earth metal chelate of an organic compound containing at least two groups capable of chelating an alkaline earth metal cation, or a hydrolysis-resistant substance consisting of a phosphorus oxyacid, its ester or its inorganic salt and an aliphatic mono-, di- or tribasic carboxylic acid of 1 to 6 carbon atoms, and (c) reducing the iron(III) oxide particles thus obtained with hydrogen at temperatures of from 275° C. to form acicular ferromagnetic iron particles.

* * * * *